US011261503B2

(12) United States Patent
Palzer et al.

(10) Patent No.: US 11,261,503 B2
(45) Date of Patent: Mar. 1, 2022

(54) METHOD FOR PRODUCING A FLAT STEEL PRODUCT MADE OF A MANGANESE-CONTAINING STEEL, AND SUCH A FLAT STEEL PRODUCT

(71) Applicant: Salzgitter Flachstahl GmbH, Salzgitter (DE)

(72) Inventors: Peter Palzer, Liebenburg (DE); Thomas Evertz, Peine (DE); Manuel Otto, Cremlingen (DE); Kai Köhler, Nordstemmen (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 164 days.

(21) Appl. No.: 16/333,947

(22) PCT Filed: Sep. 13, 2017

(86) PCT No.: PCT/EP2017/072994

§ 371 (c)(1),
(2) Date: Mar. 15, 2019

(87) PCT Pub. No.: WO2018/050683

PCT Pub. Date: Mar. 22, 2018

(65) Prior Publication Data

US 2019/0203311 A1 Jul. 4, 2019

(30) Foreign Application Priority Data

Sep. 16, 2016 (DE) ..... 10 2016 117 508.0

(51) Int. Cl.

| | |
|---|---|
| ***C21D 8/02*** | (2006.01) |
| ***C21D 9/46*** | (2006.01) |
| ***C22C 38/02*** | (2006.01) |
| ***C22C 38/06*** | (2006.01) |
| ***C22C 38/60*** | (2006.01) |
| ***C21D 6/00*** | (2006.01) |
| ***C22C 38/04*** | (2006.01) |
| ***C22C 38/16*** | (2006.01) |
| ***C22C 38/12*** | (2006.01) |
| ***C22C 38/18*** | (2006.01) |
| ***C22C 38/14*** | (2006.01) |
| ***C22C 38/10*** | (2006.01) |
| ***C22C 38/00*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |

(Continued)

(52) U.S. Cl.

CPC ..... *C21D 8/0268* (2013.01); *C21D 6/002* (2013.01); *C21D 6/005* (2013.01); *C21D 6/007* (2013.01); *C21D 6/008* (2013.01); *C21D 8/0236* (2013.01); *C21D 8/0242* (2013.01); *C21D 8/0273* (2013.01); *C21D 9/46* (2013.01); *C22C 38/001* (2013.01); *C22C 38/008* (2013.01); *C22C 38/02* (2013.01); *C22C 38/04* (2013.01); *C22C 38/06* (2013.01); *C22C 38/10* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/38* (2013.01); *C22C 38/60* (2013.01); *C21D 8/0205* (2013.01); *C21D 2201/02* (2013.01); *C21D 2211/001* (2013.01); *C21D 2211/008* (2013.01)

(58) Field of Classification Search

CPC ..... C21D 8/0268
USPC ..... 148/651
See application file for complete search history.

(56) References Cited

U.S. PATENT DOCUMENTS

| | | | |
|---|---|---|---|
| 6,358,338 | B1 | 3/2002 | Guelton et al. |
| 8,069,904 | B2 | 12/2011 | Spitzer et al. |
| 2006/0174983 | A1 | 8/2006 | Gerick et al. |

(Continued)

FOREIGN PATENT DOCUMENTS

| | | |
|---|---|---|
| DE | 102 59 230 A1 | 7/2004 |
| DE | 102004054444 | 1/2006 |

(Continued)

OTHER PUBLICATIONS

Capital Steel & Wire, Inc. Hot and Cold Rolling Explained (2014) (Year: 2014).*

(Continued)

*Primary Examiner* — Coris Fung
*Assistant Examiner* — Danielle Carda
(74) *Attorney, Agent, or Firm* — Henry M. Feiereisen LLC

(57) ABSTRACT

The invention relates to a method for producing a flat steel product made of a medium manganese steel having a TRIP/TWIP effect. The aim of the invention is to achieve an improvement in the yield strength when a sufficient residual deformability of the produced flat steel product is obtained. This aim is achieved by the following steps: cold rolling a hot or cold strip, annealing the cold-rolled hot or cold strip at 500 to 840° C. for 1 minute to 24 hours, temper rolling or finishing the annealed hot or cold strip to form a flat steel product having a degree of deformability between 0.3% and 60%. The invention further relates to a flat steel product produced according to said method and to a use thereof.

13 Claims, No Drawings

(51) Int. Cl.
*C22C 38/32* (2006.01)
*C22C 38/38* (2006.01)

(56) References Cited

U.S. PATENT DOCUMENTS

| | | | | |
|---|---|---|---|---|
| 2006/0179638 | A1 | 8/2006 | Engl et al. | |
| 2011/0048589 | A1 | 3/2011 | Matsuda et al. | |
| 2012/0237388 | A1* | 9/2012 | Sawada | C22C 38/02 420/49 |
| 2013/0149526 | A1 | 6/2013 | Masuoka et al. | |
| 2013/0295409 | A1* | 11/2013 | Chin | C23C 2/28 428/653 |
| 2015/0337408 | A1 | 11/2015 | Schulz et al. | |
| 2016/0145701 | A1* | 5/2016 | Talonen | C22C 38/40 148/606 |
| 2017/0298482 | A1* | 10/2017 | Kawasaki | C22C 38/002 |
| 2018/0216207 | A1 | 8/2018 | Palzer et al. | |

FOREIGN PATENT DOCUMENTS

| | | | | |
|---|---|---|---|---|
| DE | 102005052774 | | | 6/2006 |
| DE | 102012013113 | | | 12/2013 |
| DE | 102015111866 | | | 1/2017 |
| EP | 691415 | B2 | | 8/2005 |
| EP | 2 383 353 | | | 11/2011 |
| EP | 2383353 | A2 | | 11/2011 |
| JP | 2015-175051 | | | 10/2015 |
| JP | 2017-47468 | A | | 3/2017 |
| KR | 20070085757 | A | * | 8/2007 |
| KR | 20130111214 | A | | 10/2013 |
| KR | 20140047954 | A | | 4/2014 |
| RU | 2401877 | C2 | | 10/2010 |
| RU | 2507274 | C1 | | 2/2014 |
| RU | 2524021 | C2 | | 7/2014 |
| WO | WO 2014135441 | A1 | | 9/2014 |
| WO | WO 2016/067626 | | | 4/2017 |

OTHER PUBLICATIONS

Mazur, Temper Rolling of Steel Sheet (2012) (Year: 2012).*
Translation KR-20070085757-A (Year: 2007).*
International Search Report issued by the European Patent Office in International Application PCT/EP2017/072994 dated Nov. 15, 2017.
Russian Search Report dated Oct. 7, 2019 with respect to counterpart Russian patent application 2019107482/02(014545).
Translation of Russian Search Report dated Oct. 7, 2019 with respect to counterpart Russian patent application 2019107482/02(014545).
Benedikt Ritterbach: "Qualitätsregelkreis zur Erzeugung definierter Feinblechrauheiten mit verschiedenen Texturierverfahren (Quality control loop for the generation of defined sheet roughness with different texturing processes)", in: Definierte Feinblechrauheiten, Fertigungstechnik, Series 2, No. 517, 1999.
Linda Mosecker et al: "Nitrogen in chromium-manganese stainless steels: a review on the evaluation of stacking fault energy by computational thermodynamics", Jun. 19, 2013.

* cited by examiner

METHOD FOR PRODUCING A FLAT STEEL PRODUCT MADE OF A MANGANESE-CONTAINING STEEL, AND SUCH A FLAT STEEL PRODUCT

CROSS-REFERENCES TO RELATED APPLICATIONS

This application is the U.S. National Stage of International Application No. PCT/EP2018/050683, filed Sep. 13, 2017, which designated the United States and has been published as International Publication No. WO 20181050663 and which claims the priority of German Patent Application, Serial No. 10 2016 117 508.0, filed Sep. 16, 2016, pursuant to 35 U.S.C. 119(a)-(d).

BACKGROUND OF THE INVENTION

The invention relates to a method for producing a flat steel product consisting of a medium manganese steel with a TRIP/TWIP effect, to a flat steel product produced by this method, and to a use therefor.

European patent application EP 2 383 353 A2 discloses a flat steel product consisting of a manganese steel which has a tensile strength of 900 to 1500 MPa and consists of the following elements (contents in weight percent in relation to the steel melt): C: to 0.5; Mn: 4 to 12.0; Si: up to 1.0; Al: up to 3.0; Cr: 0.1 to 4.0; Cu: up to 4.0; Ni: up to 2.0; N: up to 0.05; P: up to 0.05; S: up to 0.01, with the remainder being iron and unavoidable impurities. Optionally, one or more elements from the group "V, Nb, Ti" are provided, wherein the sum of the contents of these elements is at most equal to 0.5. This steel is said to be characterised in that it can be produced in a more cost-effective manner than high manganese steels and at the same time has high elongation at fracture values and, associated therewith, a considerably improved deformability.

Also, German laid-open document DE 10 2012 013 113 A1 already describes so-called TRIP steels which have a predominantly ferritic basic microstructure having incorporated residual austenite which can convert into martensite during deformation (TRIP effect). Owing to its intense cold-hardening, the TRIP steel achieves high values for uniform elongation and tensile strength. TRIP steels are suitable for use inter alia in structural components, chassis components and crash-relevant components of vehicles, as sheet metal blanks and as tailored welded blanks.

German laid-open document DE 10 2015 111 866 A1 discloses a deformable lightweight steel having a manganese content of 3 to 30 wt. % and TRIP/TWIP properties which has improved material properties by adding by alloying of up to 0.8 wt. % antimony (Sb) and a targeted heat treatment at 480 to 770° C. for 1 minute to 48 hours. In particular, this steel has—in addition to an improved tensile strength and elongation at fracture, an increased resistance to hydrogen-induced crack formation and hydrogen embrittlement.

German laid-open document DE 10 2005 052 774 A1 discloses a method for producing hot strips with TRIP and/or TWIP properties and high tensile strengths. The lightweight steel consisting of the main elements Fe, Mn, Si and Al is cast into a pre-strip approximating the final dimensions in protective gas, which pre-strip subsequently passes through a homogenisation zone. Then, hot rolling occurs until the predetermined overall degree of deformation of greater than 70% is achieved. The hot strip is then annealed in a recrystallising manner prior to cold-forming. Following this, the finished hot strip is cooled and cold rolled multiple times, wherein intermediate annealing processes are performed as required between the individual cold rolling processes.

Furthermore, German patent DE 10 2004 054 444 B3 discloses a method for producing metal components or semi-finished products with high strength and plasticity by cold-forming of steels. The cold-forming of the steels is said to lead to hardening by TWIP (Twinning Induced Plasticity) or SIP (Shearband Induced Plasticity) effects. The degrees of deformation in the case of full elongation is in the range of 10 to 70%. Deformation occurs after final-stage or crystallisation annealing until a strength increase of at least 30% of the starting value is achieved and the remaining tensile elongation of the metal falls to not lower than 20%. This deformation process with high elongation is said to be advantageous in that, despite the high strength values, a plasticity reserve is retained which allows subsequent final forming into a finished component by means of conventional forming techniques. The steels selected for this are characterised by an Mn content in wt. % of 10 to 30. Such high manganese, alloyed steels are more costly than medium manganese steels owing to the high contents of alloying elements.

Proceeding therefrom, the object of the present invention is to provide a method for producing a flat steel product consisting of a medium manganese steel, a flat steel product produced by this method and a use therefor, which objects are characterised by an improvement in the yield strength whilst obtaining a sufficient residual deformation capability of the produced flat steel product.

SUMMARY OF THE INVENTION

In accordance with the invention, the object is achieved by a method for producing a flat steel product of a medium manganese steel having a TRIP/TWIP effect, the method comprising the steps of: —cold rolling a hot or cold strip, —annealing the cold-rolled hot or cold strip at 500 to 840° C. for 1 min to 24 h, —temper rolling or skin pass rolling the annealed hot or cold strip to form a flat steel product with a degree of deformation between 0.3% and 60%.

A method, according to the invention achieves that the yield strength of the flat steel product is increased owing to the temper rolling or skin pass rolling of the flat steel product. In a conventional manner, the degree of deformation relates to the thickness direction of the flat steel product. By way of the increase in the yield strength, optimised components having a lower sheet thickness can be produced from this flat steel product. The temper rolling or skin pass rolling causes a partial conversion of the metastable austenite of the annealed hot or cold strip into deformation twins (TWIP effect) and martensite (TRIP effect), wherein at least a portion of 3% of the austenite has to be converted into martensite and at least a portion of 10% of the austenite is retained as the face-centred cubic phase.

Advantageous embodiments of the invention are described in the dependent claims.

In relation to the temper rolling, provision is preferably made that the annealed hot or cold strip is temper rolled with a degree of deformation between 10 to 40%.

In relation to the skin pass rolling, provision is preferably made that the annealed hot or cold strip is skin pass rolled with a degree of deformation between 0.6 to 2.2%.

Provision is preferably made that the annealed hot or cold strip is temper rolled or skin pass rolled at a temperature of 0 to 400° C. Deformation twins are hereby formed (TWIP effect) which increase the yield strength and/or elasticity limit in a similar manner to the dislocation density of other types of steel.

In a preferred embodiment, the annealed hot or cold strip is temper rolled or skin pass rolled to form a flat steel product until the flat steel product has a yield strength which is increased by at least 50 MPa compared with the state prior to the temper rolling or skin pass rolling.

In a particularly preferred manner, provision is made that the flat steel product has a tensile strength of greater than 1300 MPa and an elongation at fracture A80 of greater than 3%.

In an advantageous embodiment of the method, the hot or cold strip is cold rolled in a first rolling pass at a temperature of the hot or cold strip of 60° C. to below Ac3, preferably 60° C. to 450° C. The hot or cold strip is then optionally intermediately heated or intermediately cooled between the subsequent rolling passes following the first rolling pass to temperatures of 60° C. to below Ac3, preferably 60° C. to 450° C. A reduction in the required deformation forces is also associated with the increase in the temperature prior to the first rolling pass. An increase in the residual deformation capability of the cold-rolled hot or cold strip with tensile strengths of greater than 800 MPa to 2000 MPa at elongations of fracture of greater than 3% is also produced in the regions which are deformed to the greatest extent. The hot or cold strip can be pre-heated for a coil or wound strip or panel material. By way of the cold rolling with pre-heating of the hot or cold strip prior to the first deformation step, conversion of the metastable austenite into martensite (TRIP effect) is completely or partially suppressed during the rolling process, wherein deformation twins (TWIP effect) can form in the austenite. An advantageous reduction in the rolling forces is hereby achieved, and the overall deformation capability is increased. By way of the subsequent rolling passes at elevated temperatures, deformation twins are introduced in a targeted manner which are then converted into martensite at room temperature and as a result increase the energy absorption capability and permit a higher degree of deformation.

The flat steel product in accordance with the invention is understood to mean a cold-temper-rolled thick plate, hot strip and/or cold strip.

In a particularly preferred manner, provision is made that the flat steel product is produced with the following chemical composition (in wt. %) in order to achieve the described advantages:

C: 0.0005 to 0.9, preferably 0.05 to 0.35

Mn: 4 to 12, preferably greater than 5 to less than 10 with the remainder being iron including unavoidable steel-associated elements, with optional addition by alloying of:

Al: 0 to 10, preferably 0.05 to 5, particularly preferred greater than 0.5 to 3

Si: 0 to 6, preferably 0.05 to 3, particularly preferred 0.1 to 1.5

Cr: 0 to 6, preferably 0.1 to 4, particularly preferred greater than 0.5 to 2.5

Nb: 0 to 1, preferably 0.005 to 0.4, particularly preferred 0.01 to 0.1

V: 0 to 1.5, preferably 0.005 to 0.6, particularly preferred 0.01 to 0.3

Ti: 0 to 1.5, preferably 0.005 to 0.6, particularly preferred 0.01 to 0.3

Mo: 0 to 3, preferably 0.005 to 1.5, particularly preferred 0.01 to 0.6

Sn: 0 to 0.5, preferably less than 0.2, particularly preferred less than 0.05

Cu: 0 to 3, preferably less than 0.5, particularly preferred less than 0.1

W: 0 to 5, preferably 0.01 to 3, particularly preferred 0.2 to 1.5

Co: 0 to 8, preferably 0.01 to 5, particularly preferred 0.3 to 2

Zr: 0 to 0.5, preferably 0.005 to 0.3, particularly preferred 0.01 to 0.2

Ta: 0 to 0.5, preferably 0.005 to 0.3, particularly preferred 0.01 to 0.1

Te: 0 to 0.5, preferably 0.005 to 0.3, particularly preferred 0.01 to 0.1

B: 0 to 0.15, preferably 0.001 to 0.08, particularly preferred 0.002 to 0.01

P: less than 0.1, preferably less than 0.04

S: less than 0.1, preferably less than 0.02

N: less than 0.1, preferably less than 0.05.

This flat steel product consisting of the medium manganese TRIP (TRansformation Induced Plasticity) and/or TWIP (TWinning Induced Plasticity) steel has excellent cold-formability and warm-formability, increased resistance to hydrogen-induced delayed crack formation (delayed fracture), to hydrogen embrittlement and to liquid metal embrittlement during welding in the galvanised state.

In a conventional manner, the previously described flat steel product is produced by a production route described hereinafter:

melting a steel melt with the above-described chemical composition in a, via the process route, blast furnace steel plant or electric arc furnace steel plant with optional vacuum treatment of the melt;

casting the steel melt to form a pre-strip by means of a horizontal or vertical strip casting process approximating the final dimensions or casting the steel melt to form a slab or thin slab by means of a horizontal or vertical slab or thin slab casting process, heating the pre-strip to a rolling temperature of 1050 to 1250° C. or in-line rolling out of the casting heat (first heat), hot rolling the pre-strip or the slab or the thin slab to form a hot strip having a thickness of 20 to 0.8 mm at a final rolling temperature of 1050 to 800° C., reeling the hot strip at a temperature of more than 100 to 800° C., acid-cleaning the hot strip, annealing the hot strip in a continuous annealing installation or batch-type—or discontinuous—annealing installation for an annealing time of 1 min to 24 h and at temperatures of 500° C. to 840° C., cold rolling the hot strip at room temperature, preferably with pre-heating to 60° C. to below Ac3 temperature, preferably 60° C. to 450° C. prior to the first rolling pass to reduce the rolling forces and form deformation twins in the austenite and, as required, cooling or heating between the rolling passes to 60° C. to below the Ac3 temperature, preferably 60° C. to 450° C., annealing the cold-rolled hot or cold strip at 500 to 840° C. for 1 min to 24 h via continuous or batch-type annealing, temper rolling or skin pass rolling the annealed hot or cold strip to increase the yield strength with smooth or textured rolls (e.g. with PRETEX texturing), optionally electrolytically galvanising or hot-dip galvanising the steel strip or applying another organic or inorganic coating, optionally annealing at 500 to 840° C. for 1 min to 24 h in a continuous annealing installation or batch-type—or other discontinuous—annealing installation.

Typical thickness ranges for the pre-strip are 1 mm to 35 mm and for slabs and thin slabs they are 35 mm to 450 mm. Provision is preferably made that the slab or thin slab is hot rolled to form a hot strip having a thickness of 20 mm to 0.8 mm or the pre-strip, cast to approximately the final dimensions, is hot rolled to form a hot strip having a thickness of 8 mm to 0.8 mm. The cold strip has a thickness of typically less than 3 mm, preferably 0.1 to 1.4 mm.

In the context of the above method in accordance with the invention, a pre-strip produced with the two-roller casting process and approximating the final dimensions and having a thickness of less than or equal to 3 mm, preferably 1 mm to 3 mm is already understood to be a hot strip. The pre-strip thus produced as a hot strip does not have a cast structure owing to the introduced deformation of the two rollers running in opposite directions. Hot rolling thus already takes place in-line during the two-roller casting process which means that separate heating and hot rolling is not necessary.

The cold rolling of the hot strip can take place at room temperature or advantageously at elevated temperature with one heating process prior to the first rolling pass and/or with heating processes in a subsequent rolling pass or between several rolling passes. The cold rolling at elevated temperature is advantageous in order to reduce the rolling forces and to aid the formation of deformation twins (TWIP effect). Advantageous temperatures of the material being rolled prior to the first rolling pass are 60° C. to below Ac3 temperature, preferably 60 to 450° C.

If the cold rolling is performed in a plurality of rolling passes, it is advantageous to intermediately heat or cool down the steel strip between the rolling passes to a temperature of 60° C. to below Ac3 temperature, preferably 60° C. to 450° C. because the TWIP effect is brought to bear in a particularly advantageous manner in this region. Depending upon the rolling speed and degree of deformation, intermediate heating, e.g. at very low degrees of deformation and rolling speeds, and also additional cooling, caused by heating the material with rapid rolling and high degrees of deformation, can be performed.

After cold rolling of the hot strip at room temperature, the steel strip is to be annealed in a continuous annealing installation or batch-type—or other discontinuous—annealing installation advantageously for an annealing time of 1 min to 24 h and at temperatures of 500 to 840° C., in order to restore sufficient forming properties. If required in order to achieve specific material properties, this annealing procedure can also be performed with the steel strip rolled at elevated temperature.

After the annealing treatment, the steel strip is advantageously cooled to a temperature of 250° C. to room temperature and subsequently, if required, in order to adjust the required mechanical properties, in the course of ageing treatment, is reheated to a temperature of 300 to 450° C., is maintained at this temperature for up to 5 min and subsequently is cooled to room temperature. The ageing treatment can be performed advantageously in a continuous annealing installation.

The flat steel product produced hi this manner can optionally be electrolytically galvanised or hot-dip galvanised. In one advantageous development, the steel strip produced in this manner acquires a coating on an organic or inorganic basis instead of or after the electrolytic galvanising or hot-dip galvanising. They can be e.g. organic coatings, synthetic material coatings or lacquers or other inorganic coatings, such as e.g. iron oxide layers.

In accordance with the invention, a use of a component produced by the previously described method is advantageously provided in the automotive industry, rail vehicle construction, shipbuilding, plant design, infrastructure, the aerospace industry, household appliances and in tailored welded blanks.

A flat steel product produced by the method in accordance with the invention advantageously has an elasticity limit Rp0.2 of 300 to 1350 MPa, a tensile strength Rm of 1100 to 2200 MPa and an elongation at fracture A80 of more than 4 to 41%, wherein high strengths tend to be associated with lower elongations at fracture and vice versa:

Rm of over 1100 to 1200 MPa: Rm×A80≥25000 up to 45000

Rm of over 1200 to 1400 MPa: Rm×A80≥20000 up to 42000

Rm of over 1400 to 1800 MPa: Rm×A80≥10000 up to 40000

Rm of over 1800 MPa: Rm×A80≥7200 up to 20000

The test piece type 2 having an initial measuring length of A80 was used for the elongation at fracture tests as per DIN 50 125.

The use of the term "to" in the definition of the content ranges, such as e.g. 0.01 to 1 wt. %, means that the limit values—0.01 and 1 in the example—are also included.

Alloy elements are generally added to the steel in order to influence specific properties in a targeted manner. An alloy element can thereby influence different properties in different steels. The effect and interaction generally depend greatly upon the quantity, presence of further alloy elements and the solution state in the material. The correlations are varied and complex. The effect of the alloy elements in the alloy in accordance with the invention will be discussed in greater detail hereinafter. The positive effects of the alloy elements used in accordance with the invention will be described hereinafter.

Carbon C: is required to form carbides, stabilises the austenite and increases the strength. Higher contents of C impair the welding properties and result in the impairment of the elongation and toughness properties, for which reason a maximum content of 0.9 wt. %, preferably 0.35 wt. % is set. In order to achieve the desired combination of strength and elongation properties of the material, a minimum addition of 0.0005 wt. %, preferably 0.05 wt. % is necessary.

Manganese Mn: stabilises the austenite, increases the strength and the toughness and renders possible a deformation-induced martensite formation and/or twinning in the alloy in accordance with the invention. Contents of less than 4 wt. % are not sufficient to stabilise the austenite and thus impair the elongation properties, whereas with contents of 12 wt. % and more the austenite is stabilised too much and as a result the strength properties, in particular the 0.2% elasticity limit, are reduced. For the manganese steel in accordance with the invention having medium manganese contents, a range of greater than 5 to less than 10 wt. % is preferred.

Aluminium Al: Al improves the strength and elongation properties, decreases the relative density and influences the conversion behaviour of the alloy in accordance with the invention. Excessively high contents of Al impair the elongation properties. Higher Al contents also considerably impair the casting behaviour in the continuous casting process. This produces increased outlay when casting. High Al contents delay the precipitation of carbides in the alloy in accordance with the invention. Therefore, an Al content of 0 to 10 wt. %, preferably 0.05 to 5 wt. %, in a particularly preferred manner greater than 0.5 to 3 wt. %, is set.

Silicon Si: the optional addition of Si in higher contents impedes the diffusion of carbon, reduces the relative density and increases the strength and elongation properties and toughness properties. Furthermore, an improvement in the cold-rollability could be seen by adding Si by alloying. Higher Si contents result in embrittlement of the material and negatively influence the hot- and cold-rollability and the coatability e.g. by galvanising. Therefore, an Si content of 0 to 6 wt. %, preferably 0.05 to 3 wt. %, in a particularly preferred manner 0.1 to 1.5 wt. %, is set.

Chromium Cr: the optional addition of Cr improves the strength and reduces the rate of corrosion, delays the formation of ferrite and perlite and forms carbides. Higher contents result in impairment of the elongation properties. Therefore, a Cr content of 0 to 6 wt. %, preferably 0.1 to 4 wt. %, in a particularly preferred manner greater than 0.5 to 2.5 wt. %, is set.

Microalloy elements are generally added only in very small amounts. In contrast to the alloy elements, they mainly act by precipitate formation but can also influence the properties in the dissolved state. Small added amounts of the microalloy elements already considerably influence the processing properties and final properties. Particularly in the case of hot-forming, microalloy elements advantageously influence the recrystallisation behaviour and effect grain refinement.

Typical microalloy elements are vanadium, niobium and titanium. These elements can be dissolved in the iron lattice and form carbides, nitrides and carbonitrides with carbon and nitrogen.

Vanadium V and niobium Nb: these act in a grain-refining manner in particular by forming carbides, whereby at the same time the strength, toughness and elongation properties are improved. Contents of more than 1.5 wt. % or 1 wt. % do not provide any further advantages. For vanadium and niobium, a minimum content of 0.005 wt. % and a maximum content of 0.6 wt. % or 0.4 wt. % are optionally preferred, with a minimum content of 0.01 wt. % and a maximum content of 0.3 wt. % or 0.1 wt. % being particularly preferred.

Titanium Ti: acts in a grain-refining manner as a carbide-forming agent, whereby at the same time the strength, toughness and elongation properties are improved, and reduces the inter-crystalline corrosion. Contents of Ti of more than 1.5 wt. % impair the elongation properties, for which reason a maximum content of 1.5 wt. %, preferably 0.6 wt. %, in a particularly preferred manner 0.3 wt. %, is optionally set. Minimum contents of 0.005 wt. %, preferably 0.01 wt. %, can be provided in order to bind nitrogen and advantageously precipitate Ti.

Molybdenum Mo: acts as a carbide-forming agent, increases the strength and increases the resistance to delayed crack formation and hydrogen embrittlement. High contents of Mo impair the elongation properties. Therefore, an Mo content of 0 to 3 wt. %, preferably 0.005 to 1.5 wt. %, in a particularly preferred manner greater than 0.01 to 0.6 wt. %, is optionally set.

Tin Sn: tin increases the strength but, similar to copper, accumulates beneath the scale layer and at the grain boundaries at higher temperatures. This results, owing to the penetration into the grain boundaries, in the formation of low-melting phases and, associated therewith, in cracks in the microstructure and in solder brittleness, for which reason a maximum content of 0.5 wt. %, preferably less than 0.2 wt. %, in a particularly preferred manner less than 0.05 wt. %, is optionally provided.

Copper Cu: reduces the rate of corrosion and increases the strength. Contents of above 3 wt. % impair the producibility by forming low-melting phases during casting and hot rolling, for which reason a maximum content of 3 wt. %, preferably less than 0.5 wt. %, in a particularly preferred manner less than 0.1 wt. %, is optionally set.

Tungsten W: acts as a carbide-forming agent and increases the strength and heat resistance. Contents of W of more than 5 wt. % impair the elongation properties, for which reason a maximum content of 5 wt. % is optionally set. A content of 0.01 wt. % to 3 wt. % is preferred, and 0.2 to 1.5 wt. % is particularly preferred.

Cobalt Co: increases the strength of the steel, stabilises the austenite and improves the heat resistance. Contents of more than 8 wt. % impair the elongation properties. Therefore, the Co content is set to at most 8 wt. %, preferably 0.01 to 5 wt. %, in a particularly preferred manner 0.3 to 2 wt. %.

Zirconium Zr: acts as a carbide-forming agent and improves the strength. Contents of Zr of more than 0.5 wt. % impair the elongation properties. Therefore, a Zr content of 0 to 0.5 wt. %, preferably 0.005 to 0.3 wt. %, in a particularly preferred manner 0.01 to 0.2 wt. %, is set.

Tantalum Ta: tantalum acts in a similar manner to niobium as a carbide-forming agent in a grain-refining manner and thereby improves the strength, toughness and elongation properties at the same time. Contents of over 0.5 wt. % do not provide any further improvement in the properties. Thus, a maximum content of 0.5 wt. % is optionally set. Preferably, a minimum content of 0.005 and a maximum content of 0.3 wt. % are set, in which the grain refinement can advantageously be produced. In order to improve economic feasibility and to optimise grain refinement, a content of 0.01 wt. % to 0.1 wt. % is particularly preferably sought.

Tellurium Te: tellurium improves the corrosion-resistance and the mechanical properties and machinability. Furthermore, Te increases the solidity of manganese sulphides (MnS) which, as a result, is lengthened to a lesser extent in the rolling direction during hot rolling and cold rolling. Contents above 0.5 wt. % impair the elongation and toughness properties, for which reason a maximum content of 0.5 wt. % is set. Optionally, a minimum content of 0.005 wt. % and a maximum content of 0.3 wt. % are set which advantageously improve the mechanical properties and increase the strength of MnS present. Furthermore, a minimum content of 0.01 wt. % and a maximum content of 0.1 wt. % are preferred which render possible optimisation of the mechanical properties whilst at the same time reducing alloy costs.

Boron B: boron delays the austenite conversion, improves the hot-forming properties of steels and increases the strength at ambient temperature. It achieves its effect even with very low alloy contents. Contents above 0.15 wt. % greatly impair the elongation and toughness properties, for which reason the maximum content is set to 0.15 wt. %. Optionally, a minimum content of 0.001 wt. % and a maximum content of 0.08, preferably a minimum content of 0.002 wt. % and a maximum content of 0.01, is set, in order to advantageously use the strength-increasing effect of boron.

Phosphorus P: is a trace element, it originates predominately from iron ore and is dissolved in the iron lattice as a substitution atom. Phosphorous increases the hardness by means of solid solution hardening and improves the hardenability. However, attempts are generally made to lower the phosphorous content as much as possible because inter alia it exhibits a strong tendency towards segregation owing to its low diffusion rate and greatly reduces the level of toughness. The attachment of phosphorous to the grain boundaries can cause cracks along the grain boundaries during hot rolling. Moreover, phosphorous increases the transition temperature from tough to brittle behaviour by up to 300° C. For the aforementioned reasons, the phosphorus content is limited to values of less than 0.1 wt. %, preferably less than 0.04 wt. %.

Sulphur S: like phosphorous, is bound as a trace element in the iron ore but in particular in the production route via the blast furnace process in the coke. It is generally not desirable in steel because it exhibits a tendency towards extensive segregation and has a greatly embrittling effect, whereby the elongation and toughness properties are impaired. An attempt is therefore made to achieve amounts of sulphur in the melt which are as low as possible (e.g. by deep desulphurisation). For the aforementioned reasons, the sulphur content is limited to values of less than 0.1 wt. %, preferably less than 0.02 wt. %.

Nitrogen N: N is likewise an associated element from steel production. In the dissolved state, it improves the strength and toughness properties in steels containing a higher content of manganese of greater than or equal to 4 wt. % Mn. Lower Mn-alloyed steels of less than 4 wt. % tend, in the presence of free nitrogen, to have a strong ageing effect. The nitrogen diffuses even at low temperatures to dislocations and blocks same. It thus produces an increase in strength associated with a rapid loss of toughness. Binding of the nitrogen in the form of nitrides is possible e.g. by adding titanium or aluminium by alloying, wherein in particular aluminium nitrides have a negative effect upon the deformation properties of the alloy in accordance with the invention. For the aforementioned reasons, the nitrogen content is limited to less than 0.1 wt. %, preferably less than 0.05 wt. %.

What is claimed is:

1. A method for producing a flat steel product of medium manganese steel having a TRIP/TWIP effect, said method comprising:

cold rolling a hot or cold strip;

annealing the cold-rolled hot or cold strip at a temperature of 500 to 840° C. for 1 min to 24 h;

temper rolling the annealed hot or cold strip to form a flat steel product having a degree of deformation between 10 to 35%, wherein the annealed hot or cold strip is temper rolled to form the flat steel product until the flat steel product has a yield strength which is increased by at least 50 MPa compared with prior to the temper rolling; and wherein the annealed hot or cold strip is temper rolled to form the flat steel product until a metastable austenite thereof is partially converted into deformation twins (TWIP effect) and martensite (TRIP effect), wherein at least a portion of 3% of the metastable austenite is converted into martensite and at least a portion of 10% of the metastable austenite is retained as a face-centred cubic phase.

2. The method of claim 1, wherein the hot or cold strip is cold roiled in a first rolling pass at a temperature of the hot or cold strip of 60° C. to below $AC_3$.

3. The method of claim 2, further comprising intermediately heating or intermediately cooling the hot or cold strip between rolling passes following the first rolling pass to a temperature of 60° C. to below $Ac_3$.

4. The method of claim 1, wherein the annealed hot or cold strip is temper rolled or skin pass rolled at a temperature of 0 to 400° C.

5. The method of claim 1, wherein the flat steel product has a tensile strength of greater than 1300 MPa and an elongation at fracture A80 of greater than 3%.

6. The method of claim 1, wherein the flat steel product comprises, in wt. %:

C: 0.0005 to 0.9,

Mn: 4 to 12, with the remainder being iron including unavoidable steel-associated elements.

7. The method of claim 6, further comprising adding to the flat steel product by alloying, in wt. %:

Al: 0 to 10,
Si: 0 to 6,
Cr: 0 to 6,
Nb: 0 to 1,
V: 0 to 1.5,
Ti: 0 to 1.5,
Mo: 0 to 3,
Sn: 0 to 0.5,
Cu: 0 to 3,
W: 0 to 5,
Co: 0 to 8,
Zr: 0 to 0.5,
Ta: 0 to 0.5,
Te: 0 to 0.5,
B: 0 to 0:15,
P: less than 0.1,
S: less than 0.1,
N: less than 0.1.

8. The method of claim 6, further comprising adding to the flat steel product by alloying, in wt. %:

Al: 0.05 to 5,
Si: 0.05 to 3,
Cr: 0.1 to 4,
Nb: 0.005 to 0.4,
V: 0.005 to 0.6,
Ti: 0.005 to 0.6,
Mo: 0.005 to 1.5,
Sn: less than 0.2,
Cu: less than 0.5,
W: 0.01 to 3,
Co: 0.01 to 5,
Zr: 0.005 to 0.3,
Ta: 0.005 to 0.3,
Te: 0.005 to 0.3,
B: 0.001 to 0.08,
P: less than 0.04,
5: less than 0.02,
N: less than 0.05.

9. The method of claim 6, further comprising adding to the flat steel product by alloying, in wt. %:

Al: greater than 0.5 less than or equal to 3,
Si: 0.1 to 1.5,
Cr: greater than 0.5 less than or equal to 2.5,
Nb: 0.01 to 0.1,
V: 0.01 to 0.3,
Ti: 0.01 to 0.3,
Mo: 0.01 to 0.6,
Sn: less than 0.05,
Cu: less than 0.1,
W: 0.2 to 1.5,
Co: 0.3 to 2,
Zr: 0.01 to 0.2,
Ta: 0.01 to 0.1, Te: 0.01 to 0.1,
B: 0.002 to 0.01,
P: less than 0.04,
S: less than 0.02,
N: less than 0.05.

10. The method of claim 1, further comprising coating the flat steel product metallically, inorganically or organically.

11. The method of claim 1, wherein the hot or cold strip is cold rolled in a first rolling pass at a temperature of the hot or cold strip of 60° C. to below 450° C.

12. The method of claim 11, further comprising intermediately heating or intermediately cooling the hot or cold strip between rolling passes following the first rolling pass to a temperature of 60° C. to below 450° C.

13. The method of claim 1, wherein the flat steel product comprises, in wt. %:

C: 0.05 to 0.35,
Mn: greater than 5 to less than 10,
with the remainder being iron including unavoidable steel-associated elements.

* * * * *